United States Patent [19]

Stahnke

[11] Patent Number: 5,016,513

[45] Date of Patent: May 21, 1991

[54] METHOD AND APPARATUS FOR REPRODUCING PEDALING EFFECTS IN A PIANO PERFORMANCE

[76] Inventor: Wayne L. Stahnke, 11434 McCune Ave., Los Angeles, Calif. 90066

[21] Appl. No.: 466,969

[22] Filed: Jan. 19, 1990

[51] Int. Cl.[5] ..... G10C 3/26; G10C 3/28; G10F 1/02

[52] U.S. Cl. ..... 84/19; 84/462

[58] Field of Search ..... 84/462, 609, 610, 611, 84/612, 613, 614, 615, 626, 634, 635, 636, 637, 638, 658, 687, 690, 721, 718, 701, 644, 688, 737, 766

[56] References Cited

U.S. PATENT DOCUMENTS

| | | | |
|---|---|---|---|
| 3,595,980 | 6/1971 | Tomisawa | 84/0.24 |
| 3,673,303 | 6/1972 | Amano | 84/0.01 |
| 3,943,812 | 3/1976 | Nagai | 84/1.1 |
| 4,450,749 | 5/1984 | Stahnke | 84/462 |

*Primary Examiner*—L. T. Hix
*Assistant Examiner*—Eddie Lee
*Attorney, Agent, or Firm*—Kelly Bauersfeld & Lowry

[57] ABSTRACT

There is disclosed a method and apparatus for reproducing in a player piano the pedal mechanism movements which approximate those of the original performance from a tape or other recording medium on which has been recorded data representative of the sequential positions of the piano pedal mechanisms during the original performance. A playback mechanism reads the desired pedal positions from a digitally encoded tape, and this is converted to an analog voltage representative of the desired pedal position. The voltage is then differentiated as a function of time to produce a voltage that is representative of the velocity of the pedal mechanism. A velocity sensor in the form of a permanent magnet within a coil senses the movement of the pedal mechanism in the reproducing piano to create a second signal proportional to the actual velocity of the pedal mechanism. These two signals are compared and applied through an operational amplifier to the solenoid which moves the pedal mechanism in the player piano, thereby approximating the movement of the pedal mechanism during the recorded performance.

9 Claims, 2 Drawing Sheets

METHOD AND APPARATUS FOR REPRODUCING PEDALING EFFECTS IN A PIANO PERFORMANCE

This invention relates to a method and apparatus for reproducing in a player piano pedaling effects which closely approximate those of the original piano performance. More particularly, this invention relates to a method and apparatus for translating recorded pedaling position data into dynamic pedal movements.

BACKGROUND OF THE INVENTION

In reproducing the pedaling effects of an original piano performance, the piano playing mechanisms in player pianos have treated the pedals of the piano in one of two ways. The most widespread approach to pedaling has been to treat the pedals as "on-off" devices (commonly called "bang-bang" operation), and to provide brute force actuators for operating the pedal mechanisms. In order to reduce the pedal operating noise of the brute force actuators to an acceptable level and to insure that the actuation does not occur too quickly, devices such as dash pots have been used. The "bang-bang" operation, however, does not reproduce the pedaling movements in the reproduced performance which are proportional to those of the original performance. Indeed, the "bang-bang" operation results in an artificial, mechanical quality in many reproduced performances.

The second way in which piano playing mechanisms have treated the pedals in a reproducing piano is described and illustrated in my U.S. Pat. No. 4,450,749 issued May 29, 1984. That method and apparatus provides in the reproduced performance a very true reproduction of the pedaling effects in the original performance. During the original performance, the instantaneous position of the pedal mechanism (e.g. the actuator bar, or the damper lifter tray, depending upon the particular piano pedal) is sensed and recorded. At a later time when the performance is reproduced, the actuator positions the pedal mechanism in such a way that the dampers are positioned in substantially the same way they were positioned during the original performance. Such "position pedaling" gives excellent results, but a very high price, because such position pedaling requires a linear potentiometer and very accurate adjustments. The signal from such a linear potentiometer is precisely a function of the actual or achieved position of the pedaling mechanism itself. Such position pedaling, however, has really not lent itself to use in piano kits which are to be retrofitted into existing pianos. This is not only because of the high cost of the hardware, but because in the retrofitting field, the piano playing kits must be fitted into the pianos by technicians having a wide range of skills and tools. In particular, the design of the pedaling devices must be such that relatively unskilled workers can achieve acceptable results without special training or tools. Thus, in a piano retrofit kit, it is imperative to provide a robust, simple and inexpensive arrangement for pedaling. Heretofore, in such retrofit kits the only available approach to pedaling has been the "bang-bang" operation which gives the aforementioned artificial and mechanical quality to the reproduced performance.

The present invention is intended to remedy these defects by providing a robust, simple and inexpensive arrangement for pedaling which will closely approximate the quality of the pedaling effects heretofore only achievable by position pedaling as described in U.S. Pat. No. 4,450,749. The present invention is a vast improvement over the "bang-bang" operation, which heretofore has been the only pedaling approach which could be used in low-cost and retrofittable reproducing piano kits.

SUMMARY OF THE INVENTION

The method and apparatus of the present invention reproduces in a player piano pedal mechanism movements which approximate those of the original performance, such reproduction being from a medium such as a cassette tape or compact disc on which is recorded data representative of the sequential positions of the corresponding piano pedal mechanism during the original performance.

The method comprises the steps of playing back the pedal mechanism position data which has been recorded on the medium, differentiating that data as a function of time to convert the data into a signal representative of pedal mechanism velocity, and then transducing that signal into corresponding movements of the pedal mechanism. It is preferred that the transducing of the signal into the corresponding movements of the pedal mechanism comprise the steps of sensing the movement of the pedal mechanism in the reproducing piano to create a second signal proportional to the actual velocity of the pedal mechanism in the reproducing piano, and then comparing the first and second signals to provide a difference signal which is then transduced into movement of the pedal mechanism in the player piano.

The apparatus of the invention comprises mechanism actuator means for effecting movement of the pedal mechanism in the player piano, means for time differentiating the recorded data representative of the piano pedal mechanism positions to create the first signal proportional to the velocity of the pedal mechanism moving between the recorded pedal positions, means for transducing the movement of the pedal mechanism in the player piano to create a second signal proportional to the actual velocity of the pedal mechanism in the player piano, and a difference circuit for comparing the first and second signals and for providing a difference signal. A closed loop feedback control means is provided for receiving the difference signal and applying it to the actuator means to effect movement of the pedal mechanism in the player piano to approximate the pedal mechanism movements during the original piano performance.

BRIEF DESCRIPTION OF THE DRAWINGS

We now refer to the accompanying drawings in which.

DETAILED DESCRIPTION OF THE PREFERRED EMBODIMENT

Figure 1:
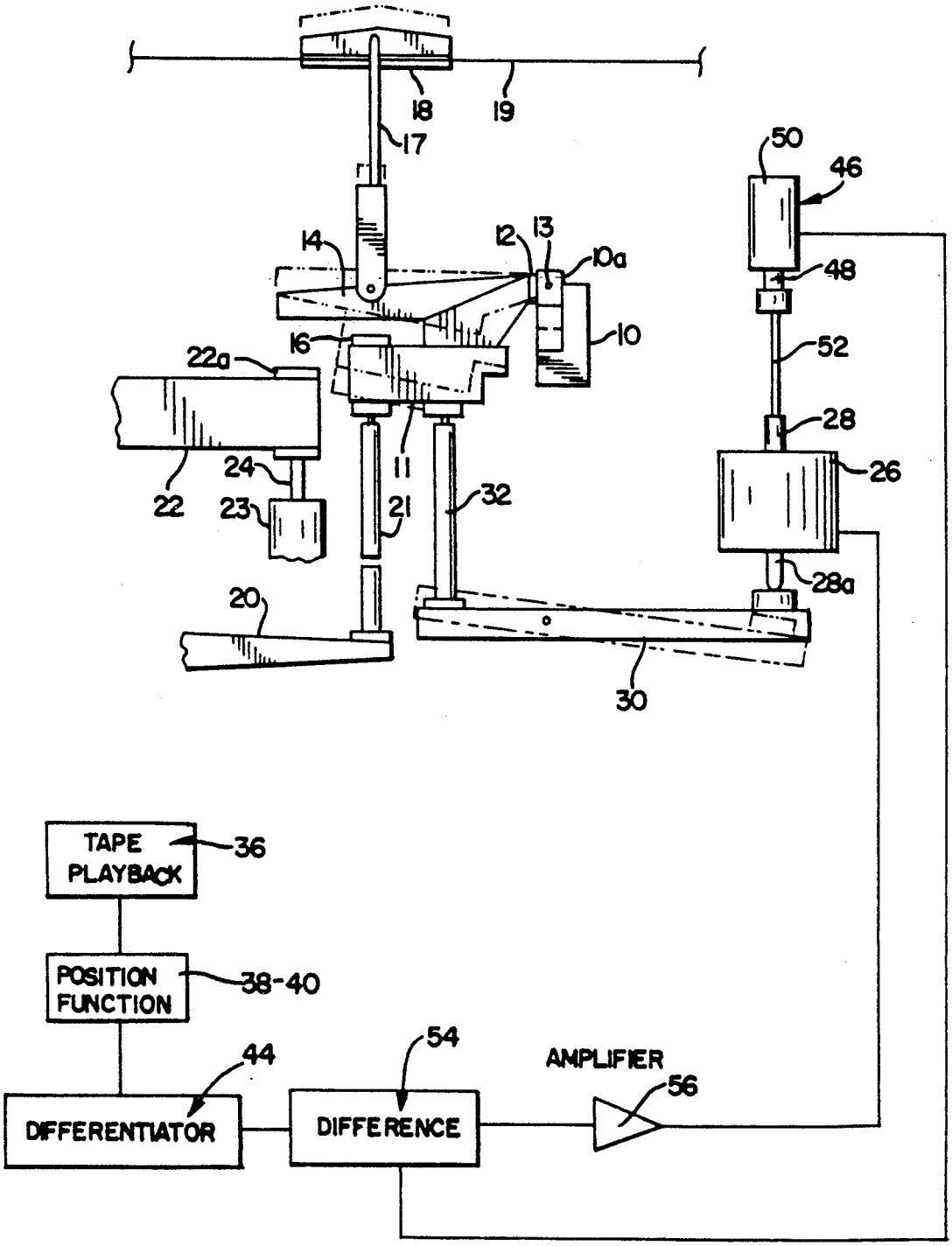
FIG. 1 is a schematic illustration of the basic piano pedal mechanisms in a player piano employing the method and apparatus of the present invention to reproduce the pedal mechanism movements of an original performance.

In FIG. 1, there is illustrated several basic components of the pedal mechanism in a typical piano such as a grand piano. This particular view is a side view. Extending approximately the width of the piano is a fixed rail 10, having a hinged member 10*a* affixed thereto. In FIG. 1, only one such hinge member 10*a* is shown, however it will be appreciated that there is a hinge member at each end of the fixed rail 10 and usually one or more between the ends. A damper lifter tray 11 also extends substantially the width of the piano, and has several end hinge members 12 (only one of which is shown in FIG. 1), each of which corresponds to and is joined to the corresponding hinge member 10*a* of the fixed rail by means of a horizontal hinge pin 13. The damper lifter tray is thus movable about the horizontal pivotal axis of the hinge pins 13 between the positions illustrated in solid lines in FIG. 1 and the position illustrated in dotted lines.

Above the damper lifter tray 11 is a damper lifter 14 which is also hingedly connected to a hinge member (not shown) affixed to the fixed rail 10 along the horizontal pivotal axis of the hinge pins 13. Thus the damper lifter 14 will be lifted upwardly and pivoted about the same axis as the damper lifter tray 11 between the solid line and dotted line positions illustrated in FIG. 1. The damper lifter tray has a felt pad 16 which extends the length of the damper lifter tray for engaging the underside of the various damper lifters 14. Each damper lifter 14 is connected through a damper wire 17 to a damper 18 adapted to engage piano strings 19. For each set of piano strings representing a note of the piano to be damped, there is a damper 18, a damper wire 17 and a damper lifter 14.

The piano sustaining pedal 20 is coupled to the underside of the damper lifter tray 11 by means of trapwork 21. Thus when the pedal 20 is depressed, it will rotate about its pivotal mounting to lift by means of the trapwork 21 the damper lifter tray 11, causing the latter to rotate about its horizontal axis as defined by the hinge pins 13. This pivotal movement of the damper lifter tray causes all of the damper lifters 14 to raise the dampers 18 from the strings 19. This is so because the damper lifter tray extends the entire width of the notes to be damped, under all of the damper lifters 14, and thus all of the damper lifters accordingly will be lifted simultaneously.

Since each of the damper lifters is associated with an individual set of piano strings representing a note of the piano, each is associated with an individual piano key 22 having a felt pad 22*a* which is adapted to engage the end of the damper lifter 14 when the key is depressed and the end of the key illustrated in FIG. 1 is pivoted upwardly. Thus the striking of the piano key will momentarily lift the damper 18 from the piano strings 19 with which the particular key and damper are associated. Since the piano illustrated in FIG. 1 is a player piano, appropriate actuating means such as the solenoid coil 23, acting through a conventional pusher rod 24, moves the key to effect striking of the piano strings by the appropriate hammers (not shown) in response to recorded signals.

In the particular automatic player illustrated, there is means for moving the pedal mechanism, i.e., the damper lifter tray, the damper lifter, and the damper, between the dotted line and solid line positions automatically in response to recorded signals. This is done by means of a pedal solenoid coil 26 having a plunger 28 which has a tip 28*a*. The plunger tip 28*a* engages a lever 30, and through the medium of the trapwork 32 is able to move the damper lifter 14 and the other portions of the pedal mechanism between their solid line and dotted line positions as illustrated in FIG. 1. Various alternate interconnections can be made between the plunger solenoid 28 and the damper lifter 14 to accomplish this movement of the damper lifter and the other portions of the pedal mechanism. The particular connection described and illustrated is only one example of this connection, and this structure thus far described is conventional in reproducing pianos.

The illustrated structure of the pedal mechanism is conventional in a grand piano. However, in the case of a vertical or upright piano, the dampers 18 are controlled by a damper actuator bar as opposed to a damper lifter tray. In connection with the soft pedal mechanism, the entire piano key frame in a grand piano is moved laterally so that only two of the set of three strings (or one of the set of two strings) will be struck by the hammer when the key is depressed, and thus, a softer note will result. Thus, the key frame and its operational mechanisms which are laterally movable to achieve this soft play function may be considered the pedal mechanism in this description, all of which is conventional. The solenoid 26 and its plunger 28 would be operatively connected to the piano key frame to effect lateral movement of the key frame for operation of the soft pedal mechanism.

Figure 2:
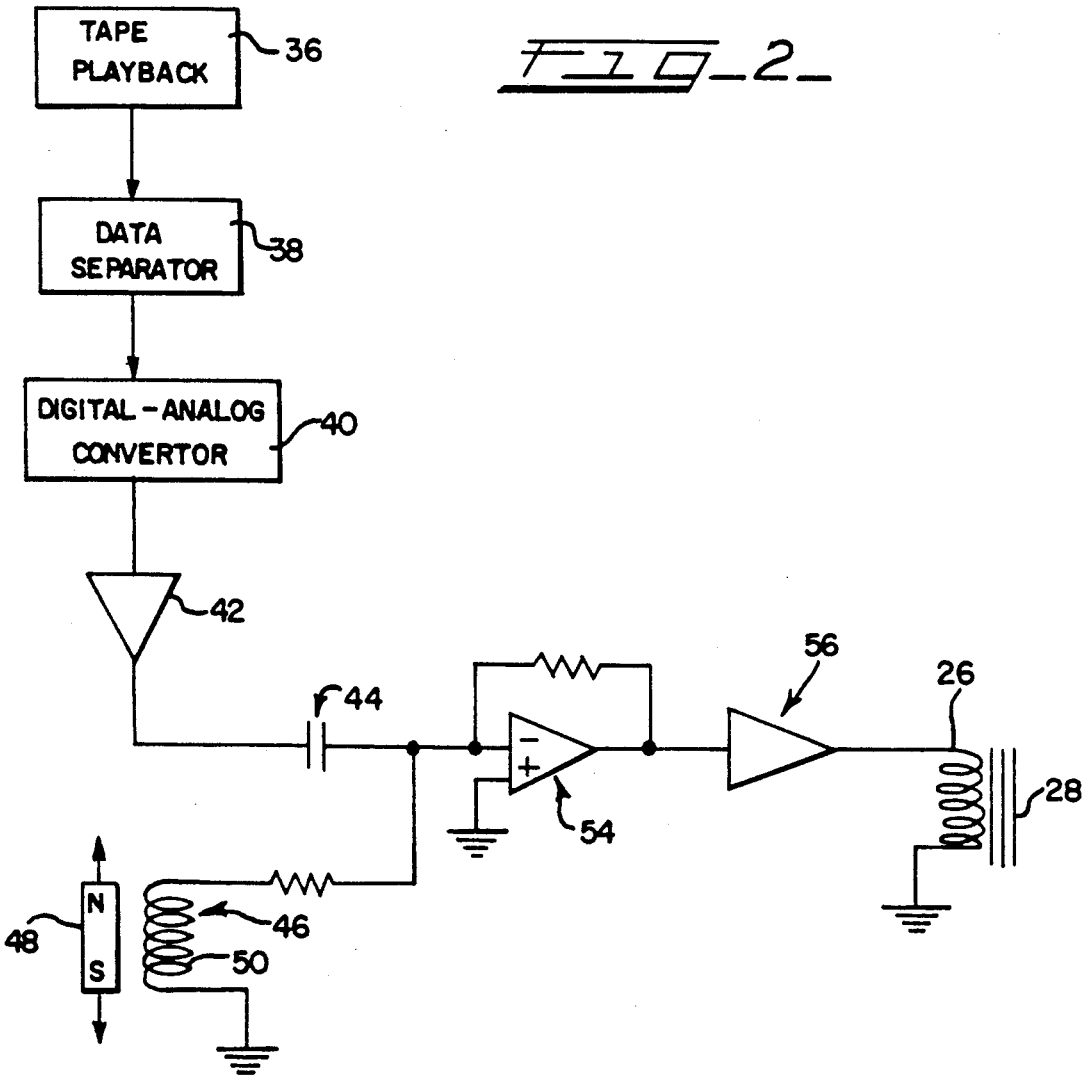
FIG. 2 is an electrical schematic diagram showing the means for achieving the reproduction of the original pedal mechanism movements in a player piano.

The means for controlling the operation of the solenoid 26 is schematically illustrated in FIG. 1, and further details are shown in FIG. 2. This control includes a playback mechanism 36, which may, for example, be a cassette tape player or a compact disc player. The recording medium has recorded thereon digital data representative of the sequential positions of the piano pedal mechanism during the original performance. When the medium is played on the playback unit 36, an electrical signal will be provided which has all of the digital information required to operate the various solenoids which will effect the play of the reproducing player piano. Among these signals will be the signals representing the various positions of the pedal mechanisms in the piano. In the case of the sustaining pedal mechanism, the information encoded on the recording medium and provided as a part of the electrical signal emanating from the playback unit 36 will include signals indicative of the position of the damper lifter tray 11 in the particular piano on which the original performance was recorded. In the case of the soft pedal mechanism, the information encoded on the recording medium which is being played back in the playback mechanism 36 and generating the signal from the playback unit will include information indicative of the position of the key frame. From these several signals, the particular pedal mechanism position signal is extracted, and that digital signal is passed to a digital to analog converter, the output of which is an analog voltage that represents the desired pedal position.

It is emphasized that up to this point all signals are indicative of pedal mechanism position. That signal must then be translated in accordance with this invention. The analog voltage indicative of pedal mechanism position is amplified in a buffer amplifier 42 and passed to a differentiator, which in the preferred embodiment is a single capacitor 44. This differentiating capacitor creates a first signal which is proportional to the velocity of the pedal mechanism in moving between the recorded pedal mechanism positions. Thus the position signals are translated into velocity signals.

Means is provided for sensing the movement of the pedal mechanism in the reproducing piano itself. This sensor, or transducer 46, in the preferred embodiment, consists of an inexpensive permanent magnet 48 formed of Alnico V movable within a coil of copper wire 50. The permanent magnet 48 in the illustrated embodiment is connected to the plunger 28 of the solenoid 26 by means of a connecting arm 52. Since the movement of the plunger 28 is in accordance with the movement of the pedal mechanisms, including the damper lifter tray 11, it has been found convenient to connect the permanent magnet part of the sensor 46 directly to the plunger 28 of the solenoid. It will be appreciated, however, that if desired, the permanent magnet 48 may be connected directly to the damper lifter tray 11, or an immediate portion of the trapwork 32. The movement of the permanent magnet 48 within the coil 50 of the sensor 46 provides a voltage across the terminals of the coil 50 which is proportional to the velocity of the permanent magnet 48, and thus proportional to the velocity of the pedal mechanism, including the damper lifter tray 11. This sensed velocity voltage is combined with the desired velocity voltage from the differentiator 44 and both are applied to a difference circuit 54, which in the preferred embodiment is an operational amplifier. The output of the difference circuit or operational amplifier is amplified in amplifier 56 and applied as a command or control signal to the solenoid coil 26, causing corresponding movement of the plunger 28 and resulting in movement of the damper lifter tray 11. This movement of the solenoid plunger also causes corresponding movement of the permanent magnet 48 within the coil 50, so that a closed loop feedback control results.

The control mechanism herein described thus takes a tape or compact disc which has been digitally encoded with pedal mechanism position sensing data, and after separating this data, differentiates it with respect to time to provide a signal proportional to the desired pedal velocity. In other words, the system translates a digitally encoded position data into an analog of the desired pedal mechanism velocity. This first voltage or signal, which is representative of the desired velocity translated from the desired position data on the recorded medium, is then compared in a difference circuit with the second signal or voltage, which is representative of the actual velocity of the pedal mechanism in the reproducing player piano as sensed by the permanent magnet 48 moving within the coil 50. The differentiated first signal proportional to the desired pedal mechanism velocity and the second signal representing the actual velocity of the pedal mechanism in the player piano are both fed into a difference circuit to provide a third signal which is the difference between the derived desired velocity and the sensed actual velocity, and this third or difference signal is then amplified and constitutes a command signal to the solenoid.

The system is thus able to employ digitally encoded position sensing data to generate movement of the pedal mechanisms which approximate those of the original performance, and the device accomplishes this without requiring expensive and sensitive components of the type required in "position pedaling" to sense instantaneous positions of the pedal mechanisms. Moreover, the mechanisms may be employed in low cost, retrofittable piano kits installed by persons of various skills while achieving greatly enhanced reproduction of piano performances utilizing pedaling effects which were heretofore unobtainable except in the vastly more expensive and more complex systems such as that described and illustrated in U.S. Pat. No. 4,450,749.

The foregoing description has been given only by way of example, and it will be apparent to those skilled in the art that many changes and modifications may be made in the specific structure described without departing from the spirit and scope of the invention as defined in the appended claims.

What is claimed is:

1. A method for reproducing in a player piano pedal mechanism movements which approximate those of the original performance from a medium on which is recorded data representative of the sequential positions of the piano pedal mechanism during the original performance, said method comprising the steps of:

(a) playing back the pedal mechanism position data recorded on the medium, (b) differentiating said data as a function of time to convert said data into a signal representative of pedal mechanism velocity, and (c) transducing said signal into corresponding movements of said pedal mechanism.

2. A method for reproducing in a player piano pedal mechanism movements which approximate those of the original performance from a medium on which is recorded data representative of the sequential positions of the piano pedal mechanism during the original performance, said method comprising the steps of:

(a) differentiating as a function of time the recorded data representative of the piano pedal mechanism positions to create a first signal proportional to the velocity of the pedal mechanism moving between the recorded pedal mechanism positions, (b) sensing the movements of the pedal mechanism in the reproducing piano to create a second signal proportional to the actual velocity of the pedal mechanism in the reproducing piano, (c) comparing said first and second signals to provide a difference signal, and (d) transducing said difference signal into movement of said pedal mechanism in the player piano, thereby approximating the movement of the pedal mechanism during the recorded performance.

3. An apparatus for reproducing in a player piano the pedal mechanism movements which approximate those of the original performance from a medium on which is recorded data representative of the positions of the piano pedal mechanism during the original performance, said apparatus comprising:

(a) mechanism actuator means for effecting movement of the pedal mechanism in the player piano, (b) means for time differentiating the recorded data representative of the piano pedal mechanism positions to create a first signal proportional to the velocity of the pedal mechanism moving between the recorded pedal positions, (c) means for sensing the movement of the pedal mechanism in the player piano to create a second signal proportional to the actual velocity of the pedal mechanism in the player piano, (d) a difference circuit for receiving and comparing said first and second signals and for providing a difference signal, and (e) closed loop feedback control means receiving said difference signal and applying it to said actuator means to effect movement of the pedal mechanism in the player piano to approximate the pedal mechanism movements during the original performance.

4. The structure of claim 3 wherein said mechanism actuator means comprises a solenoid having an element operatively connected to and movable to effect corresponding movement of the pedal mechanism.

5. The structure of claim 3 wherein said means for transducing the movement of the pedal mechanism is a coil and a permanent magnet mounted for movement within said coil and operatively connected to said pedal mechanism, whereby the movement of said pedal mechanism will cause movement of said permanent magnet within said coil to generate said second signal proportional to the actual velocity of the pedal mechanism.

6. The structure of claim 3 wherein the means for differentiating the recorded data representative of the piano pedal mechanism positions is a capacitor.

7. In a reproducing player piano, (a) an actuator solenoid having an element operatively connected to and movable to effect corresponding movement of a pedal mechanism of said player piano, (b) means for reading the desired pedal mechanism positions from a medium on which is recorded data representative of said desired pedal mechanism positions, (c) means for differentiating said pedal mechanism positions to create a signal proportional to the desired velocity of the pedal mechanism moving between the recorded positions, (d) a velocity sensor for sensing the actual velocity of the pedal mechanism actuated by said actuator solenoid to produce a signal proportional to said sensed actual velocity, (e) a difference amplifier responsive to the signals from said differentiating means and said velocity sensor for creating a difference signal proportional to the difference between said desired velocity and said sensed actual velocity, and (f) a power amplifier for amplifying said difference signal and applying the amplified signal to said actuator solenoid, whereby said actuator solenoid may move the pedal mechanism in the player piano to approximate the movements required to achieve the desired pedal mechanism positions.

8. The structure of claim 7 wherein said means for reading the desired pedal positions is a playback mechanism, a data separator for separating the pedal position data, and a digital to analog converter.

9. The structure of claim 7 wherein said velocity sensor is a coil and a permanent magnet mounted for movement within said coil and operatively connected to the movable element of said actuator solenoid.

* * * * *